US007552607B2

(12) United States Patent
Yang

(10) Patent No.: US 7,552,607 B2
(45) Date of Patent: Jun. 30, 2009

(54) DUAL PADLOCK

(76) Inventor: Yao-Kun Yang, No. 101, Lane 93, Chang Lu Road, Chang Hua City (TW)

( * ) Notice: Subject to any disclaimer, the term of this patent is extended or adjusted under 35 U.S.C. 154(b) by 0 days.

(21) Appl. No.: 11/842,623

(22) Filed: Aug. 21, 2007

(65) Prior Publication Data

US 2008/0223088 A1 Sep. 18, 2008

(51) Int. Cl.
*E05B 37/06* (2006.01)

(52) U.S. Cl. ..... 70/21; 70/25; 70/285; 70/432

(58) Field of Classification Search ..... 70/21, 70/25–28, 284, 285, 432
See application file for complete search history.

(56) References Cited

U.S. PATENT DOCUMENTS

| | | | | |
|---|---|---|---|---|
| 6,029,481 | A * | 2/2000 | Lai | 70/25 |
| 6,539,761 | B2 * | 4/2003 | Yang | 70/284 |
| 6,997,023 | B1 * | 2/2006 | Huang | 70/21 |
| 7,047,773 | B1 * | 5/2006 | Lin | 70/25 |
| 7,131,299 | B1 * | 11/2006 | Huang | 70/21 |
| 7,201,026 | B2 * | 4/2007 | Yu | 70/21 |
| 7,213,425 | B2 * | 5/2007 | Ling et al. | 70/21 |
| 7,216,517 | B2 * | 5/2007 | Ling et al. | 70/21 |
| 2003/0000264 | A1 * | 1/2003 | Yang | 70/25 |
| 2005/0235705 | A1 * | 10/2005 | Ling et al. | 70/25 |
| 2006/0243005 | A1 * | 11/2006 | Lai et al. | 70/21 |
| 2007/0227202 | A1 * | 10/2007 | Yen et al. | 70/21 |
| 2008/0011025 | A1 * | 1/2008 | Lin | 70/21 |
| 2008/0011026 | A1 * | 1/2008 | Huang | 70/21 |
| 2008/0016922 | A1 * | 1/2008 | Yu | 70/21 |
| 2008/0083251 | A1 * | 4/2008 | Lai et al. | 70/21 |
| 2008/0098774 | A1 * | 5/2008 | Huang | 70/21 |

* cited by examiner

*Primary Examiner*—Suzanne D Barrett
(74) *Attorney, Agent, or Firm*—Browdy and Neimark, P.L.L.C.

(57) ABSTRACT

A dual padlock of the present invention includes a housing, a shackle, a locking device, a locking spring, a transmission device, a key lock assembly, a code lock assembly, and a button member. The shackle is openably provided on the housing. The locking device is received in the chamber of the housing and engaged with the shackle. The key lock assembly includes a key cylinder connected to the transmission device and the locking device. The button member is connected to a shaft of the code lock assembly and the lock device. Therefore, user may insert a key into the key lock assembly and turns to unlock the padlock. User also may input the right code to the code lock assembly that will unlock the pad lock too.

11 Claims, 6 Drawing Sheets

DUAL PADLOCK

BACKGROUND OF THE INVENTION

1. Field of the Invention

The present invention relates generally to a lock, and more particularly, to a dual padlock, which may open by key or by code.

2. Description of the Related Art

Typically, conventional padlocks are classified into key lock, which may be opened by specific key, and combination lock, which may be opened by inputting specific code.

For the combination lock, if user forgot the code, he/she has to ask locksmith for help, or break the lock to open it. For the key lock, if user lost the key, he/she still has the same trouble to open it.

In addition, the Customs in airports usually ask passengers to have their luggage unlocked for a routine check. If passengers use the combination lock and forgot to open it, the Customs members will have trouble to open the luggage, sometime, they just break such luggage, and that cause dispute between passengers and Customs.

SUMMARY OF THE INVENTION

The primary objective of the present invention is to provide a dual padlock, which may be opened by key or by inputting code.

The secondary objective of the present invention is to provide a dual padlock, with which the Customs members have no trouble to open it for a routine check.

The third objective of the present invention is to provide a dual padlock, with which user is easy to identify whether his/her luggage had been opened by the key of Customs members.

To achieve the foregoing objectives of the present invention, a dual padlock includes a housing, a shackle, a locking device, a locking spring, a transmission device, a code lock assembly, and a button member. The housing has a chamber inside, two top bores, a through bore, a button bore, and a plurality of dial bores. The shackle has a pivot end and a movable end inserted into the top bores of the housing respectively. The pivot end is formed with a head portion in the chamber, and the movable end has a slot. The locking device, which is received in the chamber of the housing, has a locking portion to be moved between a first position, in which the locking portion is engaged with the slot of the shackle, and a second position, in which the locking portion is disengaged with the slot of the shackle. The locking spring is received in the chamber of the housing and urges the locking device. The key lock assembly includes a key cylinder, which is received in the chamber of the housing and has an end received in the through bore, has a keyhole and a spiral slot. The transmission device has an end received in the spiral slot of the key cylinder of the key lock assembly and opposite end touching the locking device to be moved by the key cylinder. The code lock assembly is received in the chamber of the housing and has a shaft, a plurality of numeral wheels, which are fitted to the shaft and received in the dial bores respectively, and a return spring urging the shaft. The button member is pivoted on an interior side of the housing and has a first arm, which is received in the button bore of the housing and touches the shaft of the code lock assembly, and a second arm touching the locking device. Therefore, the dual padlock of the present invention may be opened by key and by input the right code.

In addition, the combination of the present invention may be provided with a first spring and a second spring urging the movable end the pivot end of the shackle to inject the shackle when the padlock is opened. It may be provided with a block urged by the first spring to prevent the locking device from affecting the action of the first spring.

The locking portion of the locking device may be provided with a sloping face to help the engagement of the locking device and the movable end of the shackle. The locking portion of the locking device may be provided with an arched gap to be engaged with the slot of the shackle firmly.

The dual padlock of the present invention further includes an indicator. The indicator is received in the chamber of the housing and is pivoted on the housing to be moved by the transmission device between a third position, in which the indicator is on a path of the transmission device, and a fourth position, in which the indicator is on a path of the button member. The housing is provided with a window that the indicator is visible through the window when the indicator is moved to the fourth position to identify whether the dual padlock of the present invention had been opened by key.

DETAILED DESCRIPTION OF THE INVENTION

Figure 1:
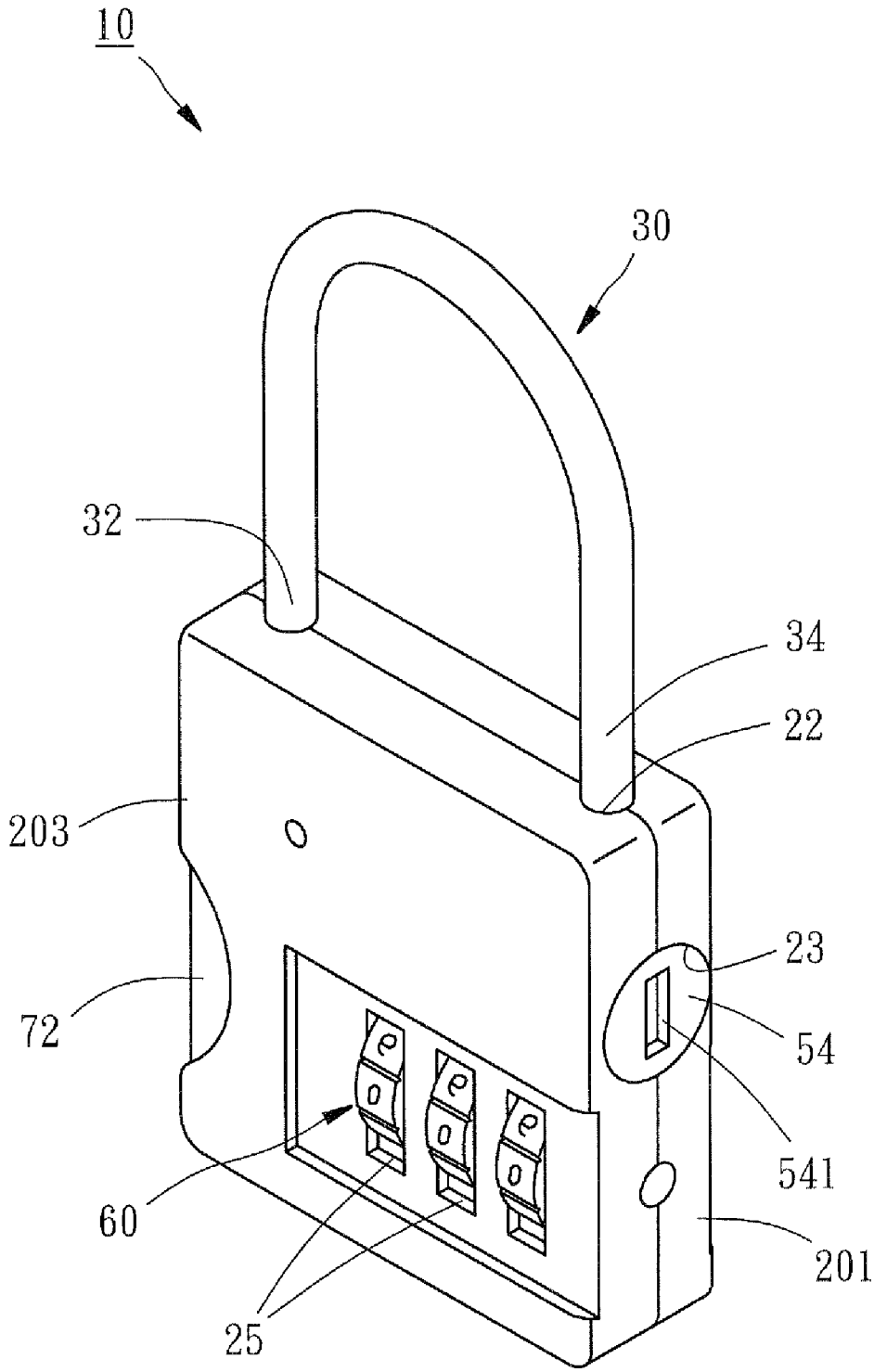
FIG. 1 is a perspective view of a first preferred embodiment of the present invention.
Figure 2:
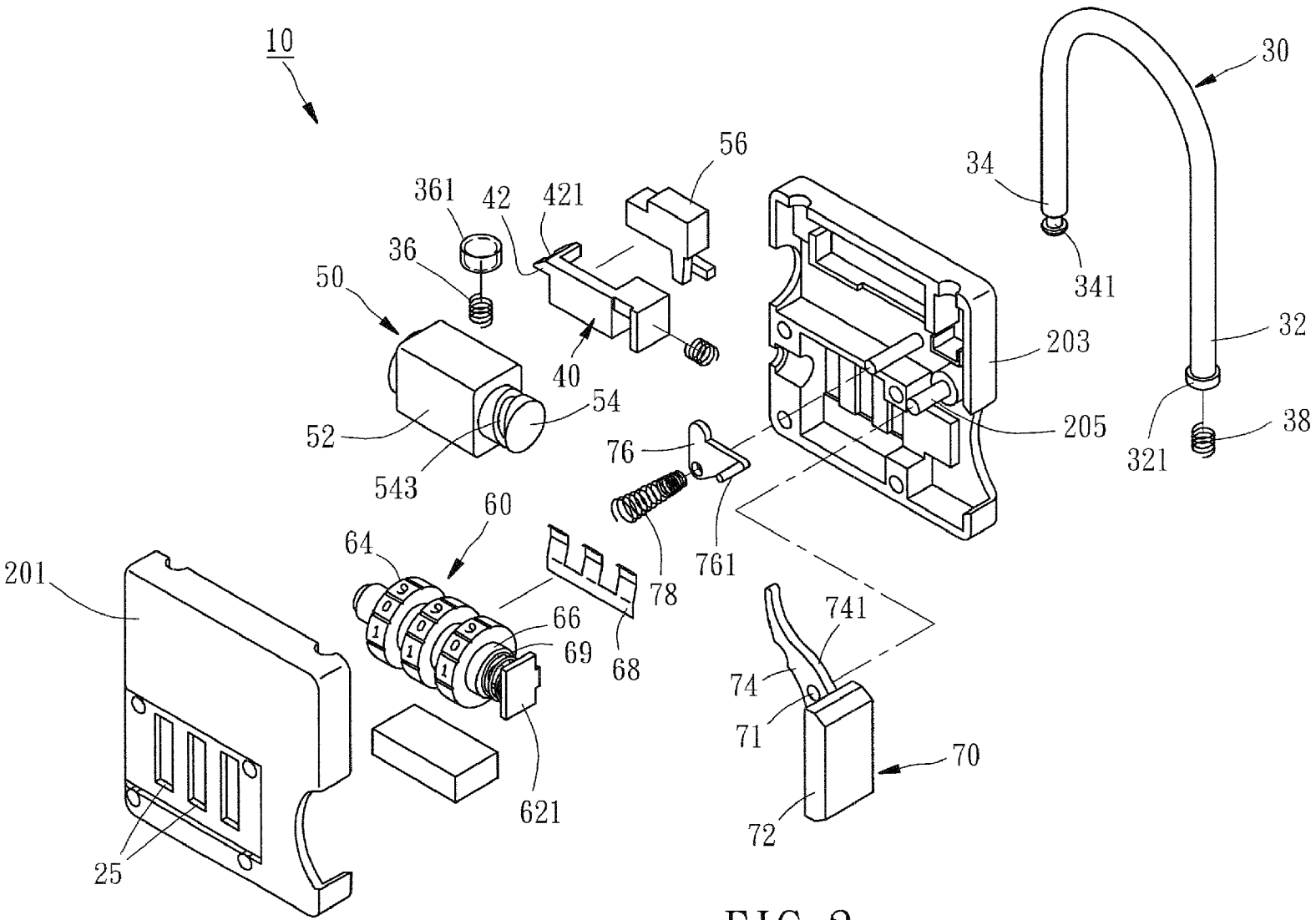
FIG. 2 is an exploded view of the first preferred embodiment of the present invention.

Referring to FIGS. 1 to 5, a dual padlock 10 constructed according to the first preferred embodiment of the present invention includes a housing 20, a shackle 30, a first spring 36, a second spring 38, a locking device 40, a locking spring 45, a key lock assembly 50, a transmission device 56, a code lock assembly 60, a button member 70, an indicator 76 and a third spring 78.

The housing 20 is constructed by a front case 201 and a rear case 103 to form a chamber 21 therein. The housing 20 has two top bores 22, a through bore 23, a button bore 24, three dial bores 25 and a window 26. The top bores 22, the through bore 23, the button bore 24, the dial bores 25 and the window 26 communicate the chamber 21 with outside.

The shackle 30 is a U-shaped bar having a pivot end 32 and a movable end 34. The pivot end 32 is inserted into one of the top bores 22 of the housing 20 and has a head portion 321 received in the chamber 21 of the housing 20. The movable end 34 is inserted into another top bore 22 of the housing 20 and has an annular slot 341.

The first spring 36 is received in the chamber 21 of the housing 20. A block 361 is urged by the first spring 36 to keep touching the movable end 34 of the shackle 32.

The second spring 38 is received in the chamber 21 of the housing 20 to urge the pivot end 32 of the shackle 32.

Figure 4:
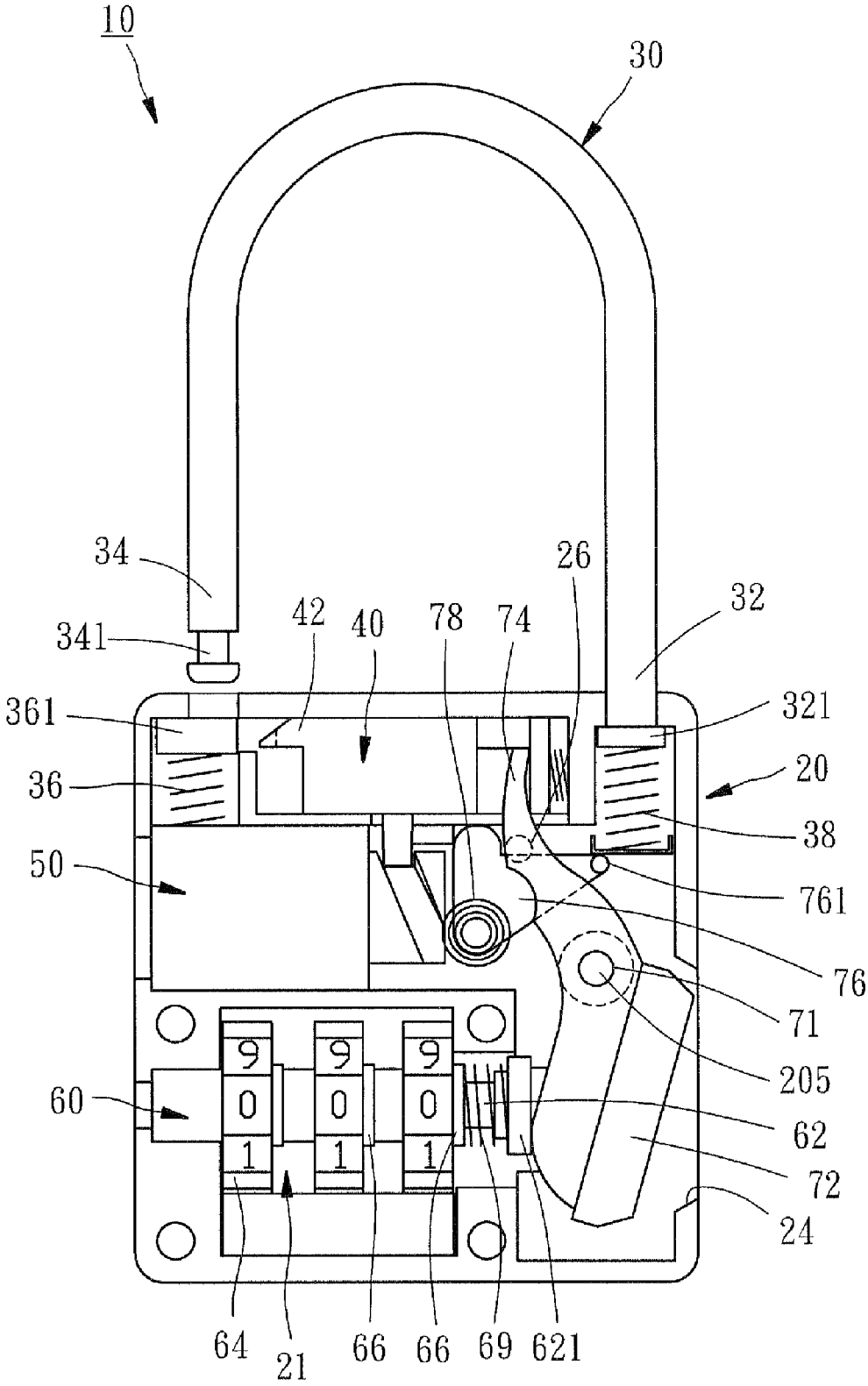
FIG. 4 is similar to in FIG. 3, showing the pad lock been opened by code.
Figure 5:
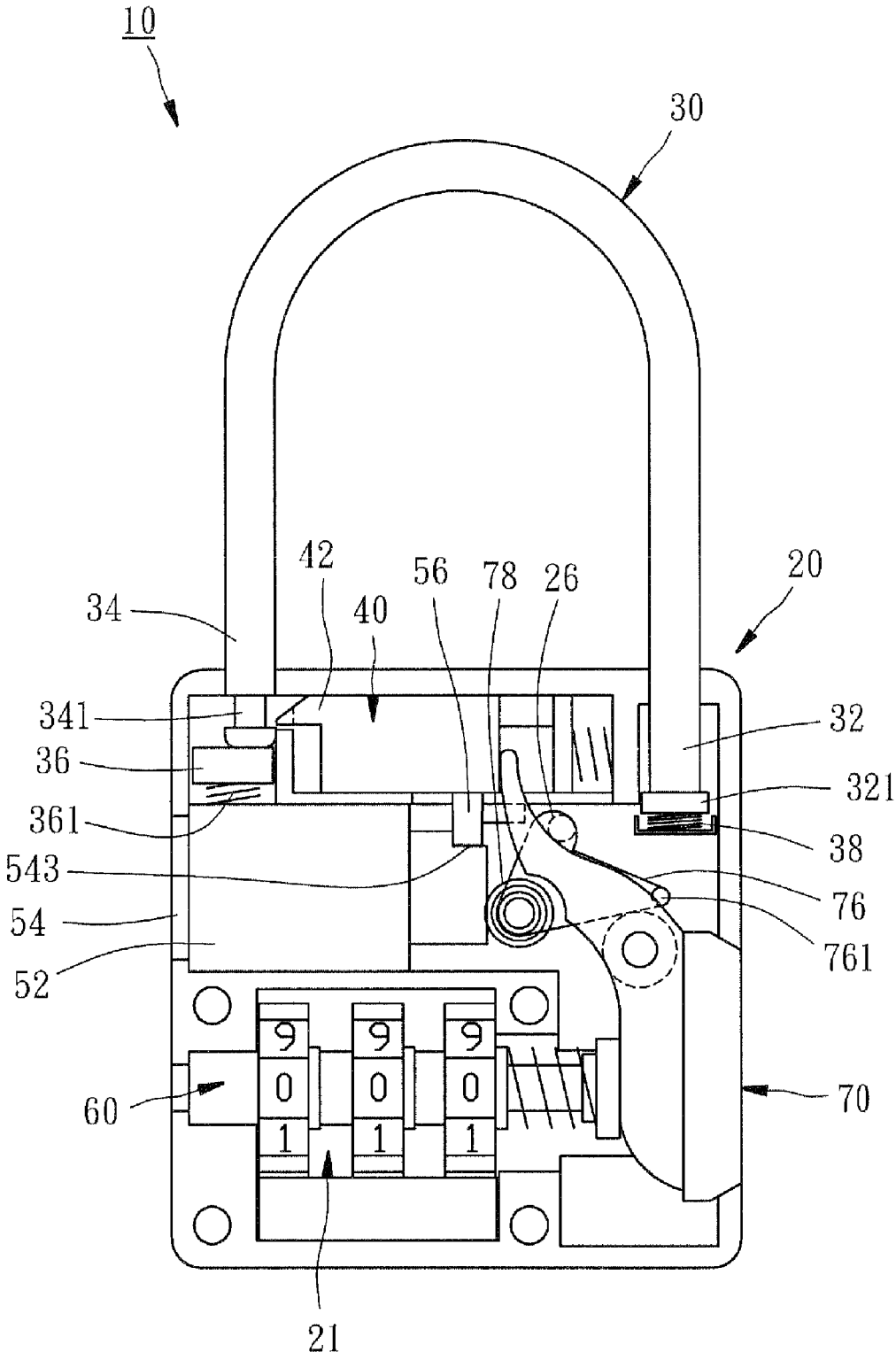
FIG. 5 is similar to in FIG. 3, showing the pad lock been opened by key.

The locking device 40, which is received in the chamber 21 of the housing 20, has a locking portion 42. The locking portion 42 includes an arched gap 421, which is complementary to a bottom end of the annular slot 341 of the shackle 30, and a sloping face 423. The locking device 40 is moved between a first position, in which the locking portion 42 is engaged with the annular slot 341 of the shackle 30 (FIG. 3), and a second position, in which the locking portion 42 is disengaged with the annular slot 341 of the shackle 30 (FIG. 4 and FIG. 5).

The locking spring 45 is received in the chamber 21 of the housing 20 to urge the locking device 40 toward the first position.

The key lock assembly 50 includes a lock base 52 received in the chamber 21 of the housing 20 and a lock cylinder 54 received in the through bore 23. The lock cylinder 54 has a keyhole 541 at an outer end thereof and a spiral slot 543 adjacent to an inner end thereof. A key (not shown) may be inserted into the keyhole 541 to turn the lock cylinder 54. The key lock assembly 50 is a conventional device, so we do not describe the detail here.

The transmission device 56 has an end inserted into the slot 543 of the lock cylinder 54 and the other end touching the locking device 40 so that the transmission device 56 is moved by the lock cylinder 54 to move the locking device 40 to the second position from the first position.

The code lock assembly 60, which is received in the chamber 21 of the housing 20, has a shaft 62, three numeral wheels 64, three locking wheels 66, a positioning spring piece 68 and a return spring 69. The shaft 62 is formed with an extending wall 621 at an end thereof. The numeral wheels 64 are fitted to the shaft 62 and received in the dial bores 25 of the housing 20 respectively to be turned by user. The locking wheels 66 fitted to the shaft 62 and touch the numeral wheels 64 respectively. The return spring 69 is fitted to the shaft 62 and urges the extending wall 621 to urge the shaft 62 toward the button member 70. When the numeral wheels 64 are turned to setting positions, the shaft 62 may be move freely, otherwise, the shaft 62 will be restricted by the locking wheels 66. The code lock assembly 60 is a conventional device, so we do not describe the detail here.

The button member 70 has a hole 71 at a center thereof to be fitted to a shaft 205 on an interior side of the rear case 203. The button member 70 further has a first arm 72, which is inside the button bore 24 and touches the extending wall 621 of the shaft 62 of the code lock assembly 60, and a second arm 74, which touches the locking device 40 to move the locking device 40 to the second position from the first position. The second arm 74 is formed with a curved face 741.

The indicator 76 is pivoted on the rear case 203 of the housing 20 and is received in chamber 21 to be swung between a third position, in which the indicator 76 is on a path of the transmission 56 (FIG. 3 and FIG. 4), and a fourth position, in which the indicator 76 is on a path of the button member 70. The indicator 76 is visible through the window 26 when it is moved to the fourth position, and is invisible when it is moved to the third position. The indicator 76 is formed with a sliding shaft 761.

The third spring 78 is received in the chamber 21 of the housing 20 to urge the indicator 76 and an inner side of the housing 20 to move the indicator 76 approaching the window 26 of the chamber 21 as possible.

Figure 3:
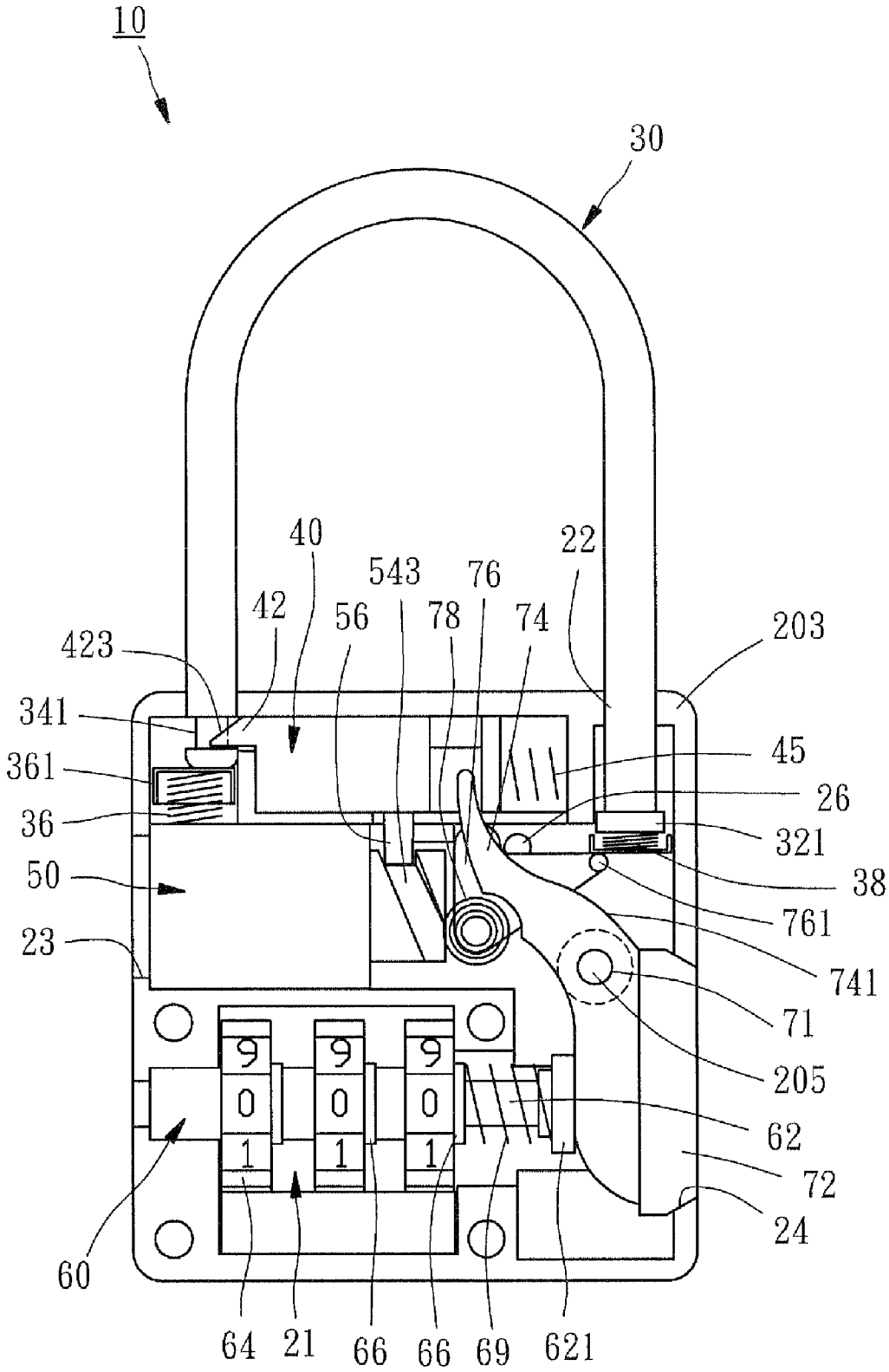
FIG. 3 is a sectional view of the first preferred embodiment of the present invention, showing the inside structure of the padlock.

When the padlock 10 of the present invention is locked, as shown in FIG. 3, the locking device 40 is at the first position to engage the locking portion 42 thereof with the annular slot 341 of the shackle 30 that the shackle 30 is secured. The first arm 72 of the button member 70 is restricted by the shaft 62 that the button member 70 can not swing in such condition. When user turns the numeral wheels 64 to the right code, the locking wheels 66 release the shaft 62, and when the user presses the first arm 72 of the button member 70, the second arm 74 of the button member 70 will move to the second position, as shown in FIG. 4, that the first spring 36 and the second spring 38 will eject the shackle 30 to unlock the padlock 10 of the present invention.

To relock the padlock 10 of the present invention, user only has to press the shackle 30 to compress the first spring 36 and the second spring 38 that the locking device 40 will moved by the locking spring 45 to the first position. As a result, the padlock 10 of the present invention is locked.

When user inserts the key (not shown) into the keyhole 541 of the key lock assembly 50 and turns, the lock cylinder 54 is turned to move the locking device 40, through the transmission device 56, to second position from the first position, as shown in FIG. 5, that the shackle 30 will be ejected to unlock the padlock 10 of the present invention. The padlock 10 of the present invention provides user choice to open it by key or by code that has much convenient to users. In addition, if user forgot to open the luggage with the padlock 10 of the present invention, the Customs member may open it by key for check procedure.

The indicator 76 is moved to the fourth position (FIG. 5) from the third position (FIG. 4) when the padlock 10 of the present invention is opened by key, and the indicator 76 will be left at the fourth position still when the padlock is relocked that user may identify whether his/her luggage had been opened by Customs member. When user presses the button member again, the second arm 74 of the button member 70 is turned clockwise to move the sliding shaft 761 of the indicator 76 along the curved face of the second arm 74 to return the indicator 76 to the third position.

Figure 6:
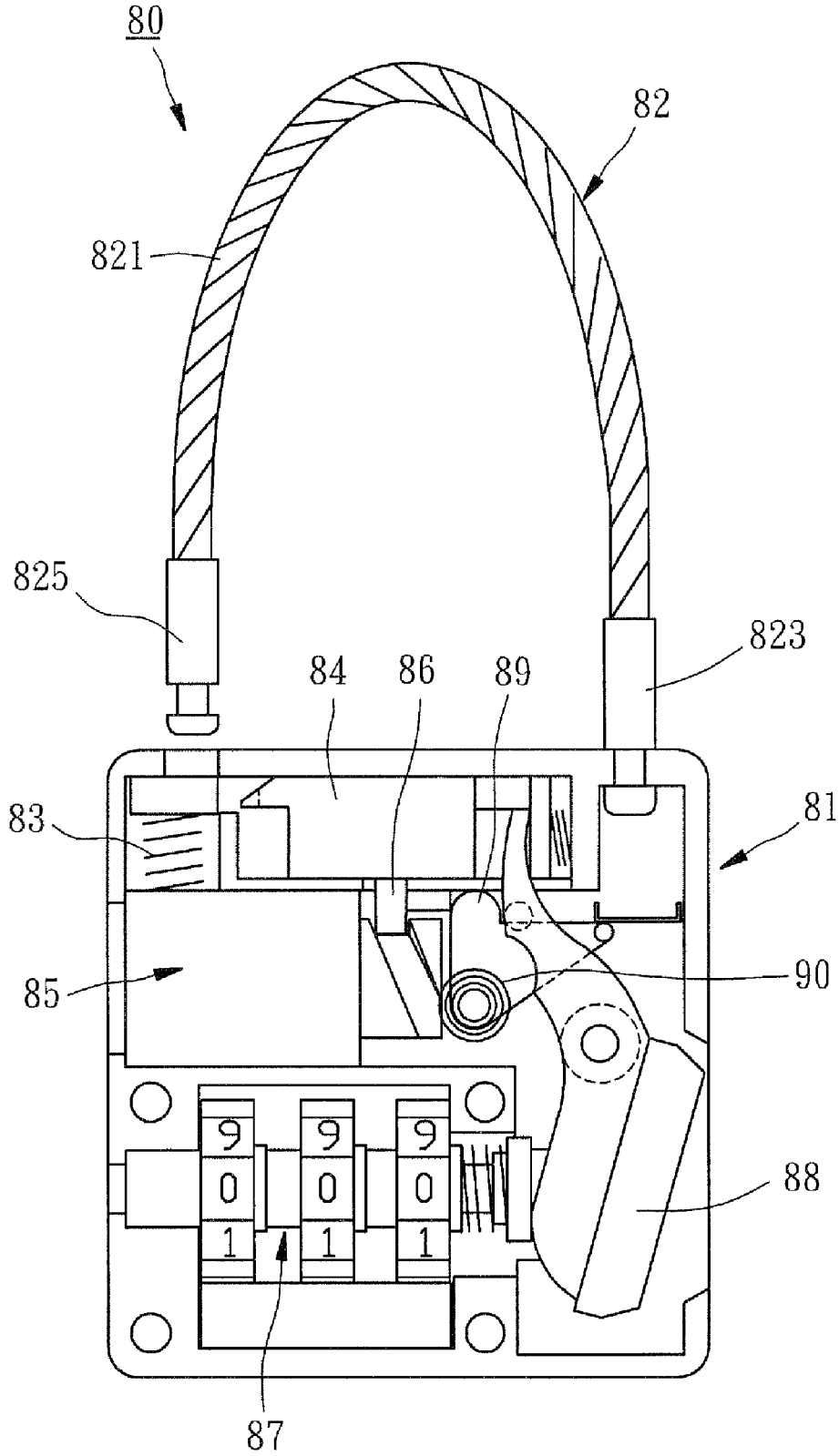
FIG. 6 is a sectional view of a second preferred embodiment of the present invention, showing the inside structure of the padlock.

There are many equivalent structures according the scope of the present invention. As shown in FIG. 6, a dual padlock 80 of the second preferred embodiment of the present invention, which is similar to the first preferred embodiment, includes a housing 81, a first spring 83, a locking device 84, a key lock assembly 85, a transmission device 86, a code lock assembly 87, a button member 88, an indicator 89 and a third spring 90. A different part of the padlock 80 of the second preferred embodiment includes that a shackle 82 having a flexible cable 821 and two connecting device 823, 825, which act as the pivot end and movable end respectively. Another different part of the padlock 80 of the second preferred embodiment is that it has no second spring.

Although a particular embodiment of the invention has been described in detail for purposes of illustration, various modifications and enhancements may be made without departing from the spirit and scope of the invention.

What is claimed is:

1. A dual padlock, comprising:

a housing having a chamber inside, two top bores, a through bore, a button bore, and a plurality of dial bores;

a shackle having a pivot end and a movable end inserted into the top bores of the housing respectively, wherein the pivot end is formed with a head portion in the chamber, and the movable end has a slot;

a locking device, which is received in the chamber of the housing, having a locking portion to be moved between a first position, in which the locking portion is engaged with the slot of the shackle, and a second position, in which the locking portion is disengaged with the slot of the shackle;

a locking spring, which is received in the chamber of the housing, urging the locking device;

a key lock assembly including a key cylinder, which is received in the chamber of the housing and has an end received in the through bore, having a keyhole and a spiral slot;

a transmission device having an end received in the spiral slot of the key cylinder of the key lock assembly and opposite end touching the locking device to be moved by the key cylinder;

a code lock assembly, which is received in the chamber of the housing, having a shaft, a plurality of numeral wheels, which are fitted to the shaft and received in the dial bores respectively, and a return spring urging the shaft; and a button member, which pivoted on an interior side of the housing, having a first arm, which is received in the button bore of the housing and touches the shaft of the code lock assembly, and a second arm touching the locking device;

the padlock further comprising an indicator received in the chamber of the housing;

wherein the second arm of the button member is formed with a curved face, and the indicator has a sliding shaft sliding on the curved face.

2. The dual padlock as defined in claim 1, further comprising a first spring received in the chamber of the housing and urging the movable end of the shackle.

3. The dual padlock as defined in claim 2, further comprising a block urged by the first spring to touch the movable end of the shackle.

4. The dual padlock as defined in claim 2, further comprising a second spring received in the chamber of the housing and urging the pivot end of the shackle.

5. The dual padlock as defined in claim 1, wherein the locking portion of the locking device has a sloping face.

6. The dual padlock as defined in claim 1, wherein the slot adjacent to the movable end of the shackle is annular.

7. The dual padlock as defined in claim 6, wherein the locking portion of the locking device has an arched gap to be engaged with the slot of the shackle.

8. The dual padlock as defined in claim 1, wherein the shaft of the code lock assembly is formed with an extending wall at an end thereof to be urged by the return spring to touch the first arm of the button member.

9. The dual padlock as defined in claim 1, wherein the shackle includes a cable and two connecting devices on opposite ends of the cable.

10. A dual padlock, comprising:

a housing having a chamber inside, two top bores, a through bore, a button bore, and a plurality of dial bores;

a shackle having a pivot end and a movable end inserted into the top bores of the housing respectively, wherein the pivot end is formed with a head portion in the chamber, and the movable end has a slot;

a locking device, which is received in the chamber of the housing, having a locking portion to be moved between a first position, in which the locking portion is engaged with the slot of the shackle, and a second position, in which the locking portion is disengaged with the slot of the shackle;

a locking spring, which is received in the chamber of the housing, urging the locking device;

a key lock assembly including a key cylinder, which is received in the chamber of the housing and has an end received in the through bore, having a keyhole and a spiral slot;

a transmission device having an end received in the spiral slot of the key cylinder of the key lock assembly and opposite end touching the locking device to be moved by the key cylinder;

a code lock assembly, which is received in the chamber of the housing, having a shaft, a plurality of numeral wheels, which are fitted to the shaft and received in the dial bores respectively, and a return spring urging the shaft;

a button member, which pivoted on an interior side of the housing, having a first arm, which is received in the button bore of the housing and touches the shaft of the code lock assembly, and a second arm touching the locking device; and an indicator, which is received in the chamber of the housing and is pivoted on the housing, to be moved by the transmission device between a third position, in which the indicator is on a path of the transmission device, and a fourth position, in which the indicator is on a path of the button member, and a window on the housing that the indicator is visible through the window when the indicator is moved to the fourth position;

wherein the second arm of the button member is formed with a curved face, and the indicator has a sliding shaft sliding on the curved face.

11. The dual padlock as defined in claim 10, wherein further comprising a third spring received in the chamber of the housing and urging the indicator and the housing respectively.

* * * * *